US006358121B1

(12) United States Patent
Zuniga

(10) Patent No.: US 6,358,121 B1
(45) Date of Patent: Mar. 19, 2002

(54) CARRIER HEAD WITH A FLEXIBLE MEMBRANE AND AN EDGE LOAD RING

(75) Inventor: Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/610,582

(22) Filed: Jul. 5, 2000

Related U.S. Application Data

(60) Provisional application No. 60/143,190, filed on Jul. 9, 1999.

(51) Int. Cl.[7] ..... B24B 7/22

(52) U.S. Cl. ..... 451/41; 451/398; 451/388

(58) Field of Search ..... 451/288, 287, 451/398, 388, 41

(56) References Cited

U.S. PATENT DOCUMENTS

| | | | | |
|---|---|---|---|---|
| 4,918,869 A | | 4/1990 | Kitta | |
| 5,193,316 A | | 3/1993 | Olmstead | |
| 5,205,082 A | | 4/1993 | Shendon et al. | |
| 5,423,716 A | | 6/1995 | Strasbaugh | |
| 5,449,316 A | | 9/1995 | Strasbaugh | |
| 5,584,751 A | | 12/1996 | Kobayashi et al. | |
| 5,605,488 A | * | 2/1997 | Ohashi et al. | 451/7 |
| 5,624,299 A | | 4/1997 | Shendon | |
| 5,643,053 A | | 7/1997 | Shendon | |
| 5,643,061 A | | 7/1997 | Jackson et al. | |
| 5,720,845 A | * | 2/1998 | Liu | 156/345 |
| 5,733,182 A | * | 3/1998 | Muramatsu et al. | 451/289 |
| 5,759,918 A | | 6/1998 | Hoshizaki et al. | |
| 5,803,799 A | | 9/1998 | Volodarsky et al. | |
| 5,851,140 A | | 12/1998 | Barns et al. | |
| 5,879,220 A | | 3/1999 | Hasegawa et al. | |
| 5,957,751 A | * | 9/1999 | Govzman et al. | 451/8 |
| 5,964,653 A | | 10/1999 | Perlov et al. | |
| 6,012,964 A | * | 1/2000 | Arai et al. | 451/5 |
| 6,080,050 A | | 6/2000 | Chen et al. | |
| 6,132,298 A | | 10/2000 | Zuniga et al. | |
| 6,146,259 A | | 11/2000 | Zuniga et al. | |
| 6,159,079 A | | 12/2000 | Zuniga et al. | |
| 6,162,116 A | | 12/2000 | Zuniga et al. | |
| 6,165,058 A | | 12/2000 | Zuniga et al. | |
| 6,183,354 B1 | | 2/2001 | Zuniga et al. | |
| 6,210,255 B1 | | 4/2001 | Zuniga et al. | |

FOREIGN PATENT DOCUMENTS

| | | | | |
|---|---|---|---|---|
| EP | 0 841 123 | | 5/1998 | |
| JP | 2243263 | | 9/1990 | |
| JP | 5069310 | * | 3/1993 | 451/41 |
| JP | 6091522 | * | 4/1994 | 451/288 |
| WO | WO 99/07516 | | 2/1999 | |

* cited by examiner

*Primary Examiner*—Robert A. Rose
(74) *Attorney, Agent, or Firm*—Fish & Richardson

(57) ABSTRACT

A carrier head for chemical mechanical polishing includes a base and a flexible membrane. A lower surface of the flexible membrane provides a substrate receiving surface of a substrate. The lower surface includes a first surface to apply a first pressure to a first portion of the substrate. A second surface surrounding the first surface applies a second pressure on a second portion of the substrate. An edge load ring surrounds the second surface. A lower surface of the edge load ring provides a third surface to apply a third pressure to a third portion of the substrate surrounding the second portion.

16 Claims, 8 Drawing Sheets

CARRIER HEAD WITH A FLEXIBLE MEMBRANE AND AN EDGE LOAD RING

CROSS-REFERENCE TO RELATED APPLICATIONS

The present application claims priority to Provisional U.S. application Ser. No. 60/143,190 filed Jul. 9, 1999.

BACKGROUND

The present invention relates generally to chemical mechanical polishing of substrates, and more particularly to a carrier head with a flexible membrane for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect," i.e., the tendency of the substrate edge to be polished at a different rate than the substrate center. The edge effect typically results in overpolishing (the removal of too much material from the substrate) at the substrate perimeter, e.g., the outermost five to ten millimeters of a 200 millimeter (mm) wafer.

SUMMARY

In one aspect, the invention is directed to a carrier head for chemical mechanical polishing. The carrier head has a base, a flexible membrane extending beneath the base to define a pressurizable chamber, an edge load ring and a retaining ring. A lower surface of the flexible membrane provides a substrate receiving surface of a substrate and includes a first surface to apply a first pressure to a first portion of the substrate. A second surface surrounds the first surface to apply a second pressure on a second portion of the substrate, and the edge load ring surrounds the second surface. A lower surface of the edge load ring provides a third surface to apply a third pressure to a third portion of the substrate surrounding the second portion. The retaining ring surrounds the edge load ring to maintain the substrate beneath the first, second and third surfaces.

Implementations of the invention may include one or more of the following features. An annular wall portion may surround and connect to the first surface of the flexible membrane. The wall portion may have a lower surface and an upper surface, the lower surface defining the second surface. A spacer ring may have a lower surface and an upper surface. The upper surface of the spacer ring may be arranged to receive a load in response to the pressurization of the chamber, and the lower surface of the spacer ring may abutting the upper surface of the wall portion, whereby the load received on the upper surface of the spacer ring is transferred to the wall portion. The spacer ring may be positioned between the edge load ring and the wall portion, or on the wall portion and substantially horizontally aligned with a top portion of the edge load ring. A surface area of the upper surface of the spacer ring may be greater than or substantially the same as a surface area of the lower surface of the spacer ring. The edge load ring may includes a top portion extending over the upper surface of the wall member and defining an upper surface of the edge load ring, and the upper surface may be configured to receive a load in response to the pressurization of the chamber and apply the second pressure to the second portion of the substrate and the third pressure to the third portion of the substrate. A surface area of the top surface of edge load ring may be greater than or less than a surface area of the lower surface of the edge load ring.

In another aspect, the invention is directed to a carrier head for chemical mechanical polishing. The carrier head has a base, a base, a flexible membrane extending beneath the base to define a pressurizable chamber, an edge load ring, and a retaining ring. A lower surface of the flexible membrane provides a first surface to apply a first pressure to a first portion of a substrate. The edge load ring surrounds the first surface and has an upper surface and a lower surface. The lower surface of the edge load ring provides a second surface for applying a second pressure to a second portion of the substrate. A surface area of the upper surface of the edge load ring is at least fifty percent of a surface area of the lower surface of the edge load ring. The retaining ring surrounds the edge load ring to maintain the substrate beneath the first and second surfaces.

Implementations of the invention may include one or more of the following features. The flexible membrane may include an annular wall portion providing a third surface to apply a third pressure to a third portion located between the first portion and the second portion of the substrate. A spacer ring may be positioned above an upper surface of the wall portion and may cooperate with the edge load ring to provide the third pressure to the third portion of the substrate.

In another aspect, the invention is directed to a carrier head for chemical mechanical polishing. The carrier head has a base, a flexible membrane extending beneath the base to define a pressurizable chamber, an edge load ring and a retaining ring. A lower surface of the flexible membrane provides a substrate receiving surface for a substrate. The lower surface includes a first surface to apply a first pressure to a first portion of the substrate and a second surface to apply a second pressure to a second portion surrounding the first portion. The edge load ring surrounds the second surface, and a contact surface of the edge load ring provides a third surface for applying a third load to a third portion of the substrate surrounding the second portion. The retaining ring surrounds the edge load ring to maintain the substrate beneath the first, second and third surfaces.

In another aspect, the invention is directed to a method of polishing a substrate. In the method, a substrate is brought into contact with a polishing surface, a first pressure to a first portion of the substrate with a first portion of a flexible membrane, a second pressure is applied to a second portion of the substrate with a second portion of the flexible membrane, and a third pressure is applied to a third portion of the substrate with an edge load ring.

Possible advantages of implementations of the invention may include one or more of the following. Overpolishing and underpolishing at the perimeter of a substrate can be reduced by applying different pressures on selected regions of the substrate.

The details of one or more embodiments of the invention are set forth in the accompanying drawings and the description below. Other advantages and features of the invention will be apparent from the following description, including the drawings and claims.

DETAILED DESCRIPTION

Figure 1:
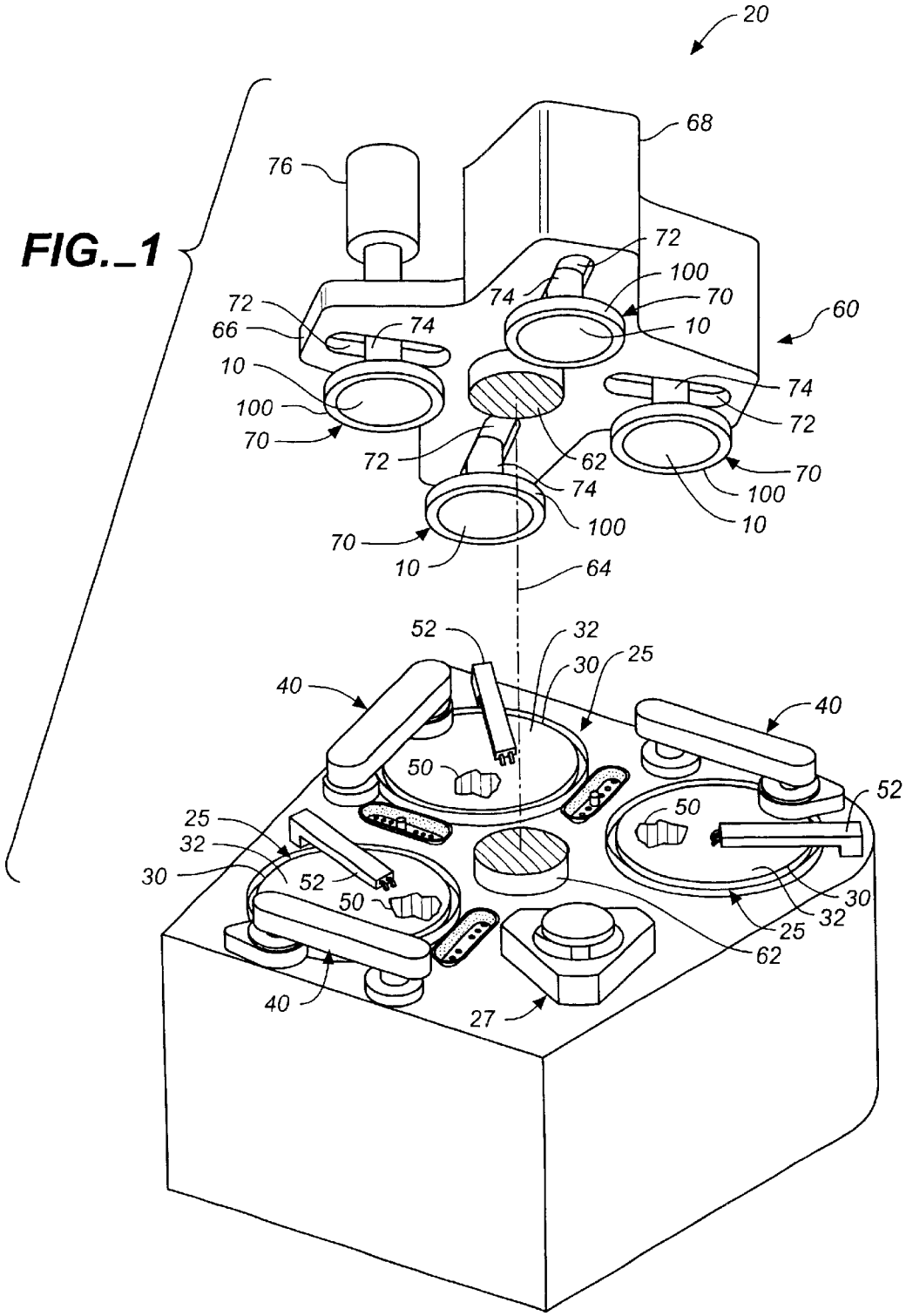
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 and polishing pad 32 may also be about twenty inches in diameter if substrate 10 is a six-inch (150 millimeter) diameter disk. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a fluid (e.g., deionized water for oxide polishing) and a pH adjuster (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations. One of the carrier head systems receives a substrate from and delivers the substrate to the transfer station. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
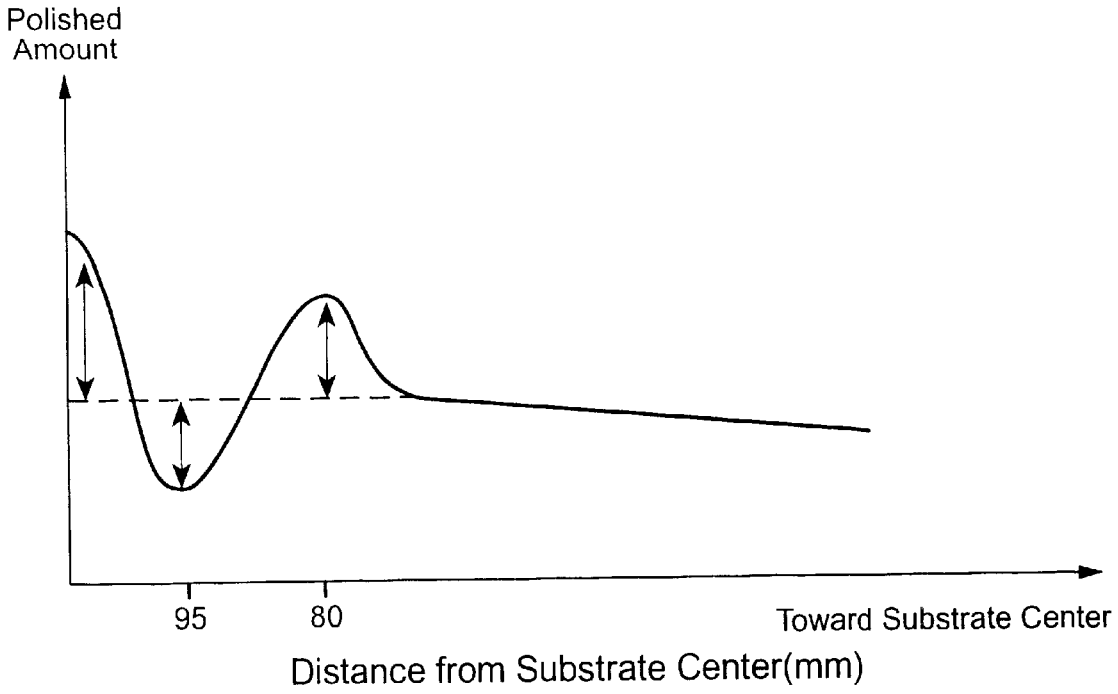
FIG. 2 illustrates non-uniform polishing rates at the perimeter of a substrate that has been polished under the chemical mechanical polishing method.

Referring to FIG. 2, a reoccurring problem in CMP is the tendency of the substrate edges to be polished at different rates than the substrate center. At the outermost perimeter portion (e.g., the outermost 3 millimeters of a 200 millimeter) of a substrate, overpolishing (the removal of too much material from the substrate)results. At an intermediate perimeter portion immediately inside of the outermost perimeter (e.g., 3 to 8 millimeters from the outermost edge), under polishing results. At an inner perimeter immediately inside of the intermediate perimeter (e.g., 8 to 20 millimeters from the outermost edge), overpolishing again results.

Figure 3:
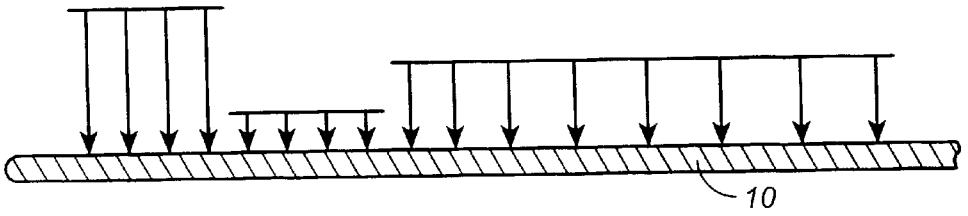
FIG. 3 illustrates that non-uniform polishing rates shown in FIG. 2 may be compensated by applying varying pressures radially along the substrate.

Referring to FIG. 3, these differences in polishing rates may be compensated by applying different pressures on the edges of substrate 10, i.e., applying more pressure at an area where underpolishing occurs and applying less pressure at an area where overpolishing occurs.

Figure 4:
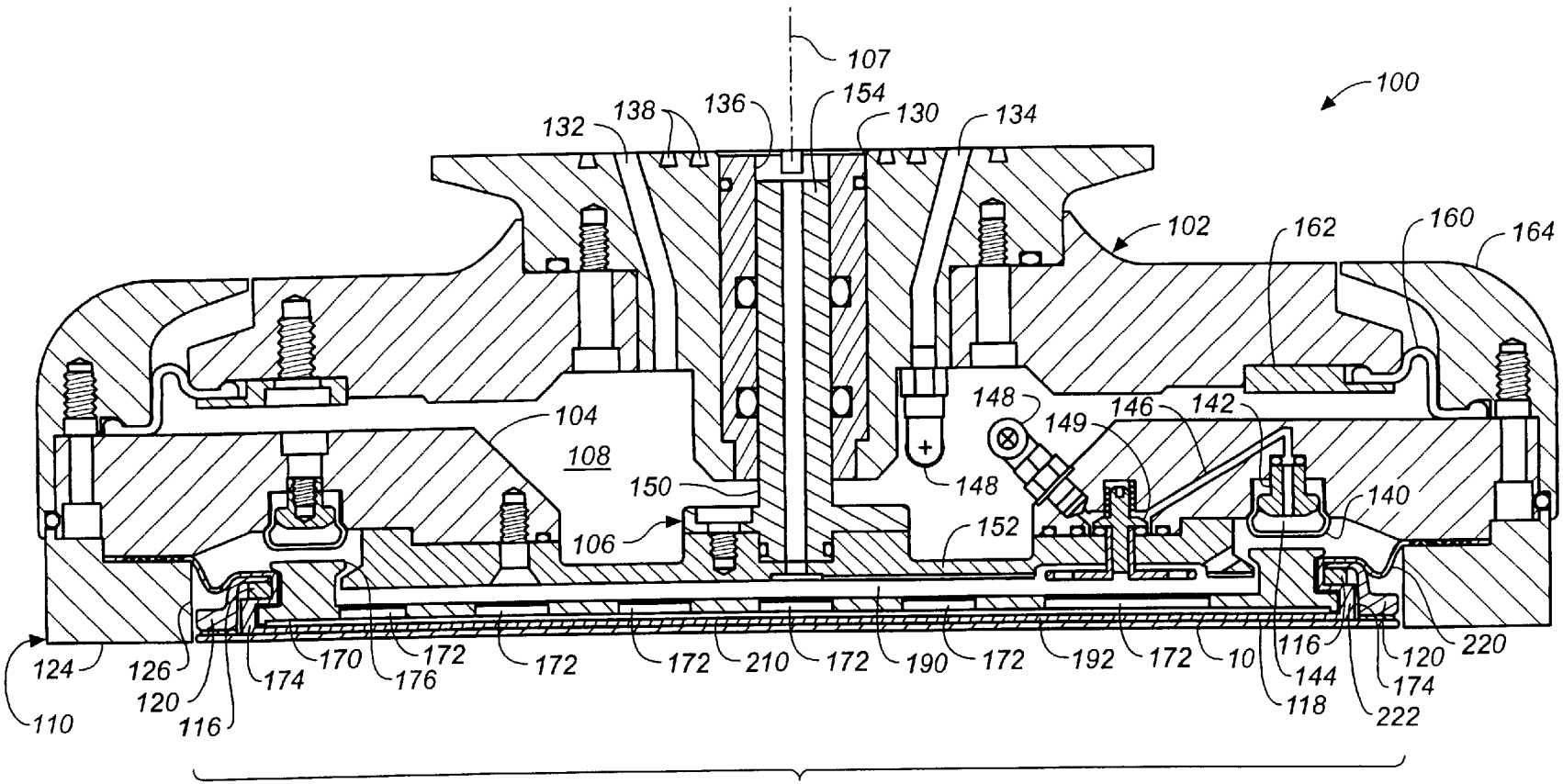
FIG. 4 is a schematic cross-sectional view of a carrier head according to the present invention.
Figure 5:
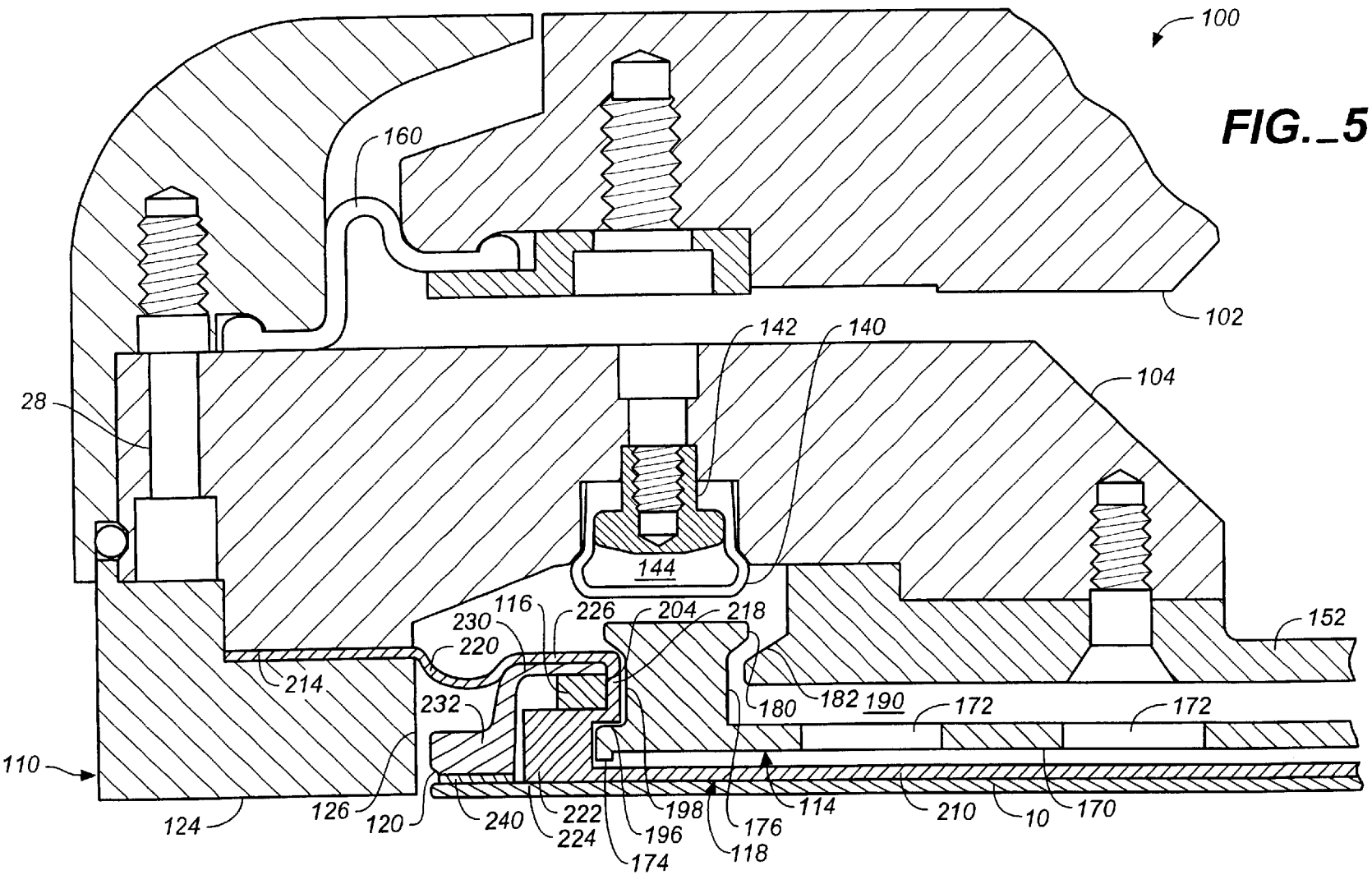
FIG. 5 is an enlarged view of the carrier head of FIG. 4 showing an edge-load ring.

Referring to FIGS. 4–5, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/745,670 by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference.

Housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A vertical bore 130 may be formed through the housing, and two passages 132 and 134 may extend through the housing for pneumatic control of the carrier head. O-rings 138 may be used to form fluid-tight seals between the passages through the housing and passages through the drive shaft.

Base 104 is a generally rigid ring-shaped or disk-shaped body located beneath housing 102. An elastic and flexible membrane 140 may be attached to the lower surface of base 104 by a clamp ring 142 to define a bladder 144. A passage 146 may extend through the clamp ring and the base, and two fixtures 148 (only the fixture attached to housing 102 is shown) may provide attachment points to connect a flexible tube between housing 102 and base 104 to fluidly couple passage 134 to bladder 144. A first pump (not shown) may be connected to bladder 144 to direct a fluid, e.g., a gas, such as air, into or out of the bladder. In addition, an actuatable valve 159 may be positioned in passage 146 and used to sense the presence of a substrate, as described in U.S. application Ser. No. 08/862,350, by Boris Govzman et al., filed May 23, 1997, entitled A CARRIER HEAD WITH A SUBSTRATE DETECTION SYSTEM FOR A CHEMICAL MECHANICAL POLISHING SYSTEM, and assigned to the assignee of the present invention, the entire disclosure of which is incorporated herein by reference.

Gimbal mechanism 106, which may be considered to be part of base 104, permits the base to pivot with respect to housing 102 so that the base may remain substantially parallel with the surface of the polishing pad. Gimbal mechanism 106 includes a gimbal rod 150 which fits into vertical bore 130 and a flexure ring 152 which is secured to base 104. Gimbal rod 150 may slide vertically in a bushing 136 located in bore 130 to provide vertical motion of base 104, but it prevents any lateral motion of base 104 with respect to housing 102. Gimbal rod 150 also includes a passage 154 that extends the length of the gimbal rod for pneumatic control of the carrier head.

An inner edge of a generally ring-shaped rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. A second pump (not shown) may be fluidly connected to loading chamber 108 by passage 132 to control the pressure in the loading chamber and the load applied to base 104. The vertical position of base 104 relative to polishing pad 32 is also controlled by loading chamber 108.

Retaining ring 110 may be a generally annular ring secured at the outer edge of base 104, e.g., by bolts 128. When fluid is pumped into loading chamber 108 and base 104 is pushed downwardly, retaining ring 110 is also pushed downwardly to apply a load to polishing pad 32. A bottom surface 124 of retaining ring 110 may be substantially flat, or it may have a plurality of channels to facilitate transport of slurry from outside the retaining ring to the substrate. An inner surface 126 of retaining ring 110 engages the substrate to prevent it from escaping from beneath the carrier head.

Substrate backing assembly 112 includes a support structure 114, a flexible member or membrane 118, a spacer ring 116 and an edge load ring 120. Substrate backing assembly 121 provides a first pressure, a second pressure and a third pressure, respectively, to a first portion (central portion), a second portion (inner perimeter portion) and a third portion (intermediate perimeter portion) of the substrate, as explained in greater detail later.

Figure 6:
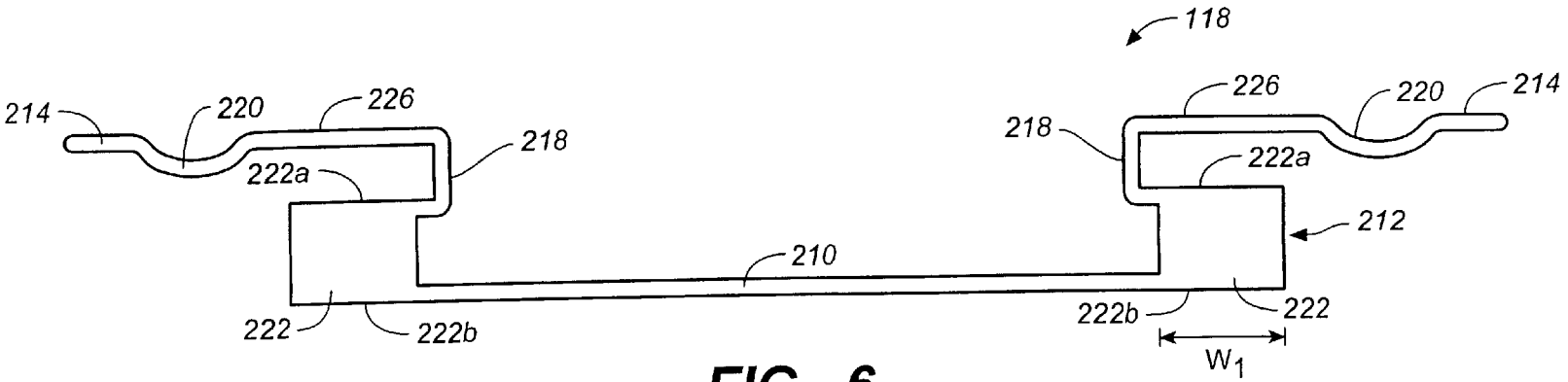
FIG. 6 is a cross-sectional view of the flexible membrane of the carrier head of FIG. 5.

Referring to FIGS. 4 and 6, flexible membrane 118 is a generally circular sheet formed of a flexible and elastic material, such as chloroprene or ethylene propylene rubber, or silicone. A central portion 210 of flexible membrane 118 extends below support structure 114 to provide a mounting surface 122 to engage the substrate. A perimeter portion 212 of the flexible membrane extends in a serpentine path between support structure 114, edge load ring 120 and spacer ring 116, and then over edge ring 120 to be secured to the carrier head, e.g., to base 104 or retaining ring 110. Perimeter portion 212 includes a thick wall portion 222 at the rim of central portion 210, a thin portion 218 that extends upwardly around outer surface 184 of support structure 114, inwardly between a lower surface **119*b* of spacer ring 116 and an upper surface 196 of support structure 114, upwardly between an inner surface 204 of spacer ring 116 and an outer surface 198 of support structure 114. The perimeter portion 212 also includes a level portion 226 that extends outwardly along an upper surface 202 of edge load ring 120. The flexible membrane 118 may terminate in a rim portion 214 which is clamped between base 104 and retaining ring 110 to form a fluid-tight seal. A curved "free span" portion 220 of the flexible membrane extends between rim portion 214 and level portion 226**. The flexible membrane may be pre-molded into a serpentine shape.

The sealed volume between flexible membrane 118 and base 104 defines a pressurizable chamber 190. A third pump (not shown) may be fluidly connected to chamber 190 by passage 154 to control the pressure in chamber 190 and thus the downward force of the mounting surface on the substrate. The pressurization of chamber 190 exerts a uniform pressure on level portion 226 and curved portion 220. Edge load ring 120 uses the uniform pressure of chamber 190 to apply two different pressures on the perimeter of substrate 10, as explained in greater detail below. In addition, chamber 190 may be evacuated to pull flexible membrane 118 upwardly and thereby vacuum-chuck the substrate to the carrier head.

The wall portion joined to central portion 210 provides a second surface to engage the inner perimeter portion of the substrate. Wall portion 222 includes an upper surface **222*a* to receive a load and a lower surface 222*b* to apply the load to the inner perimeter portion of the substrate. Assuming the downward force transferred from spacer ring 116 to upper surface 222*a* is otherwise constant, the pressure applied to the inner perimeter portion is inversely proportional to the surface area of lower surface 222*b* of wall portion 222. Specifically, the pressure (P) applied by a given force (F) varies according to the surface area (A) whereon the pressure is applied, i.e., P=F/A. The pressure applied on the inner perimeter may be controlled by designing wall portion 222 with an appropriate lower surface area. That is, if the width ($W_1$) of wall portion 222** is increased, the pressure applied to the inner perimeter of the substrate is decreased. Alternatively, if the width ($W_1$) is decreased, the pressure applied to the inner perimeter of the substrate is increased.

Support structure 114 is located inside chamber 190 to provide a rigid support for the substrate during substrate chucking, to limit the upward motion of the substrate and flexible membrane when chamber 190 is evacuated, and to maintain the desired shape of flexible membrane 118. Specifically, support structure 114 may be a generally rigid member having a disk-shaped plate portion 170 with a plurality of apertures 172 formed therethrough, and a generally annular flange portion 174 that extends upwardly from plate portion 170. In addition, plate portion 170 may have a downwardly-projecting lip 176 at its outer edge. Support structure 114 may be "free-floating", i.e., not secured to the rest of the carrier head, and may be held in place by the flexible membrane.

Flange portion 174 of support structure 114 includes a rim 180 that extends over a ledge 182 formed in base 104. When polishing is complete and loading chamber 108 is evacuated to lift base 104 away from the polishing pad, and chamber 190 is either pressurized or vented, the lower surface of rim 180 engages ledge 182 to act as a hard stop that limits the downward motion of support structure 114 and prevents overextension of the flexible membrane.

Figure 7A:
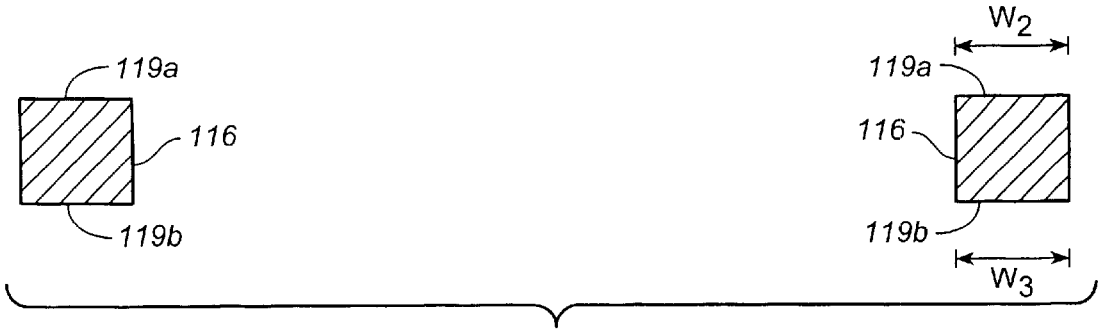
FIG. 7A is a cross-sectional view of the spacer ring of the carrier head of FIG. 5.
Figure 7B:
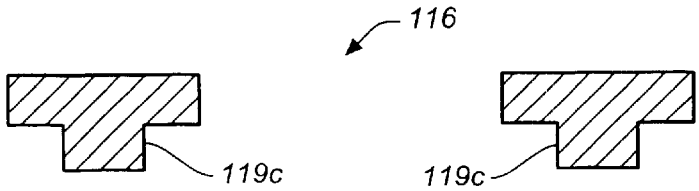
FIGS. 7B–7D are cross-sectional views of different implementations of the spacer ring of FIG. 7A.
Figure 7C:
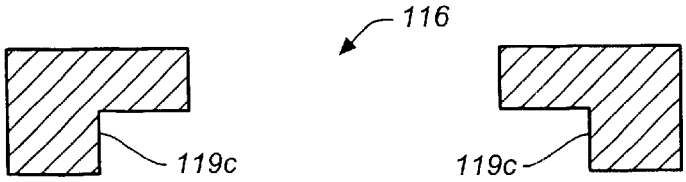
Figure 7D:
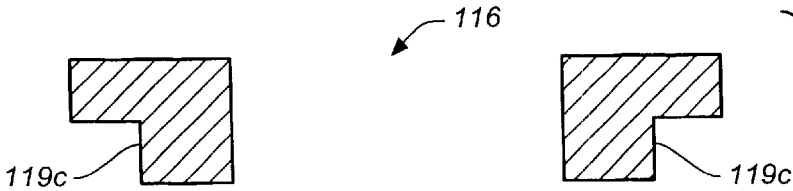

Referring to FIGS. 4 and 7A, spacer ring 116 is an annular member positioned between flexible membrane 118 and edge load ring 120 on upper surface 222*a* of wall portion 222. An upper surface 119*a* and a lower surface 119*b* of spacer ring 116 are arranged, respectively, to receive a load from chamber 190 and transfer the load to the wall portion. The load received from chamber 190 by spacer 116 is proportional to the upper surface area of the spacer ring. The width ($W_2$) of upper surface 119*a* may be varied to control the load received from chamber 190 by spacer ring 116. Similarly, the width ($W_3$) of lower surface 119*b* may be varied to control the pressure applied to wall portion 222. Referring to FIGS. 7B–7D, a base 119*c* of spacer ring 116 may be shaped to control the location on wall portion 222 where the load is applied as well as to control the amount of pressure applied to the selected area of wall portion 222.

Figure 8:
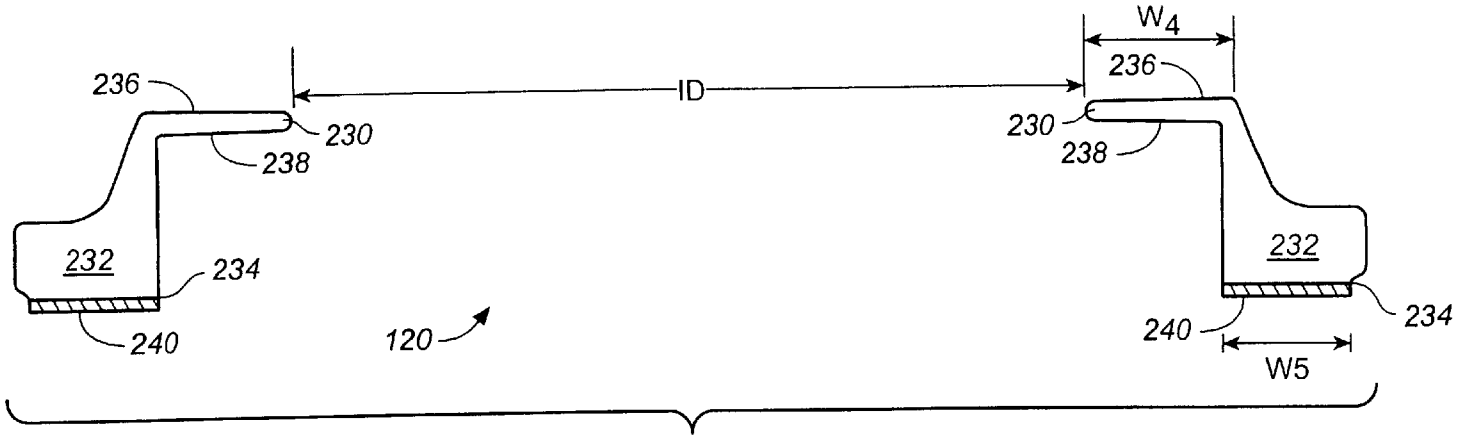
FIG. 8 is a cross-sectional view of the edge load ring of the carrier head of FIG. 5.

Referring to FIGS. 4 and 8, edge-load ring 120 is a generally annular body located between retaining ring 110 and wall portion 222. Edge-load ring 120 includes a base portion 232, a flange portion 230 that extends upwardly from base portion 232 over spacer ring 116 for receiving a load from chamber 190 via flexible membrane 118, and a substantially flat lower surface 234 for applying pressure to the perimeter portion of substrate 10. Flange portion 230 includes an upper surface 236 that contacts flexible membrane 118 and a lower surface 238 that contacts spacer ring 116.

Edge load ring 120 receives loads from level portion 226 and curved portion 220 of the flexible membrane. Curved portion 220 also exerts a load on retainer ring 110. The total load received by edge load ring 120 is proportional to the surface area of its upper surface 236 in contact with level portion 226. The surface area of upper surface 236 should be at least fifty percent of the surface area of lower surface 238 of the edge load ring. The surface area of upper surface 236 may be varied by adjusting the width ($W_4$) of flange portion 230 to control the load received by edge load ring 120. The width ($W_4$) should be relatively wide to receive sufficient load from chamber 190 so that the second pressure and the third pressure may be applied to the inner perimeter portion and the intermediate perimeter portion of the substrate, respectively.

Edge load ring 120 applies the second pressure to the inner perimeter portion by transferring a portion of the total load received from chamber 190 to spacer ring 116. The load transferred to spacer ring 116 is proportional to the surface area of upper surface 119*a* of spacer ring 116 that contacts the edge load ring. If the upper surface area of spacer ring 116 is increased, the portion of total load transferred to spacer ring 116 from edge load ring 120 would be increased. Conversely, if the upper surface area of spacer ring 116 is decreased, the portion of total load transferred to spacer ring 116 from edge load ring 120 would be decreased.

The remaining load on the edge load ring 120, i.e., the portion that is not transfered to spacer ring 116, is transferred to lower surface 234 to apply the third pressure to the intermediate perimeter portion of the substrate. The pressure applied to the intermediate perimeter may be controlled by appropriately selecting the width ($W_5$) of lower surface 234 of the edge load ring.

Therefore, carrier head 100 can apply three different pressures on the substrate by using a uniform pressure in chamber 190. Central portion 210 applies the first pressure on the central portion of the substrate. Load assembly 121 applies the second pressure and the third pressure on the inner perimeter portion and the intermediate perimeter portion, respectively. The second and third pressures may be controlled by selecting an appropriate ratio of the upper surface area of the edge load ring, the lower surface area of the edge load ring, the upper surface area of the spacer ring, and the lower surface area of the wall portion.

Edge-load ring 120 is composed of a material, such as a stainless steel, ceramic, anodized aluminum, or plastic, e.g., polyphenylene sulfide (PPS), that is relatively rigid compared to the flexible membrane. A layer 240 of compressible material, such as a carrier film, may be adhesively attached to lower surface 234 of base portion 232 to provide a mounting surface for the substrate.

In one implementation, the width ($W_1$) of wall portion 222 of flexible membrane 118 may be in the range of 0.15 to 0.3 inches, spacer ring 116 has an inner diameter ($ID_1$) of about 6.2 inches, the width ($W_2$) of upper surface 119*a* and the width ($W_3$) of lower surface 119*b* of spacer ring 116 may both be in the range of 0.05 to 0.10 inches, ), edge load ring 120 may have an inner diameter ($ID_2$) of about 6.35 inches, the width ($W_4$) of flange portion 230 of edge load ring 120 may be in the range of 0.5 to 0.6 inches, and the width ($W_5$) of lower surface 234 of edge load ring 120 may be in the range of 0.4 to 0.5 inches.

Figure 9:
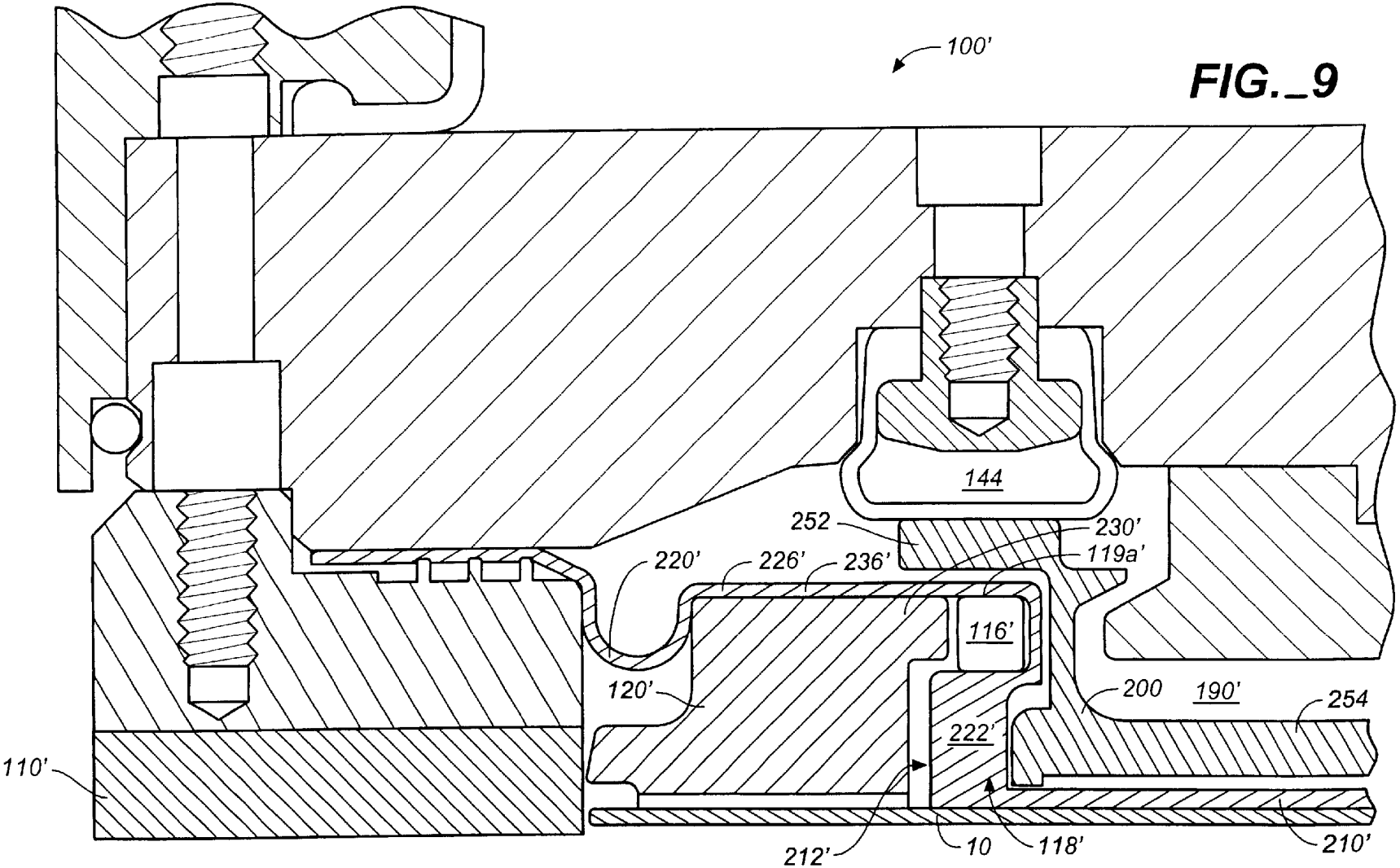
FIG. 9 is a schematic cross-sectional view of a carrier head according to one embodiment of the present invention.

Referring to FIG. 9, a carrier head 100' includes a support structure 200 and a load assembly 121' which includes a flexible membrane 118' having an inner portion 120' and a wall portion 222', a spacer ring 116' and an edge load ring 120'. Support structure 200 includes a generally annular rim 202 projecting between edge load ring 120' and bladder 144.

Spacer ring 116' is positioned on wall portion 222' and in contact with a level portion 226' of flexure diaphragm 116'. A flange portion 230' of edge load ring 120' is arranged horizontal to spacer ring 116', so that an upper surface 236' of edge load ring 120' is substantially coplanar with an upper surface 119*a* of spacer ring 116'. A lip portion 148' of edge load ring 120' is substantially shorter than lip portion 148 of edge load ring 120'.

In operation, the pressurization of a chamber 190' applies loads to central portion 210' of flexible membrane 1118', spacer ring 116' and edge load ring 120'. In turn, central portion 210' applies a first pressure to the central portion of the substrate, spacer ring 116' applies a second pressure to the inner perimeter of the substrate via wall portion 222' of the flexible membrane, and edge load ring 120' applies a third pressure to the intermediate perimeter of the substrate.

Figure 10:
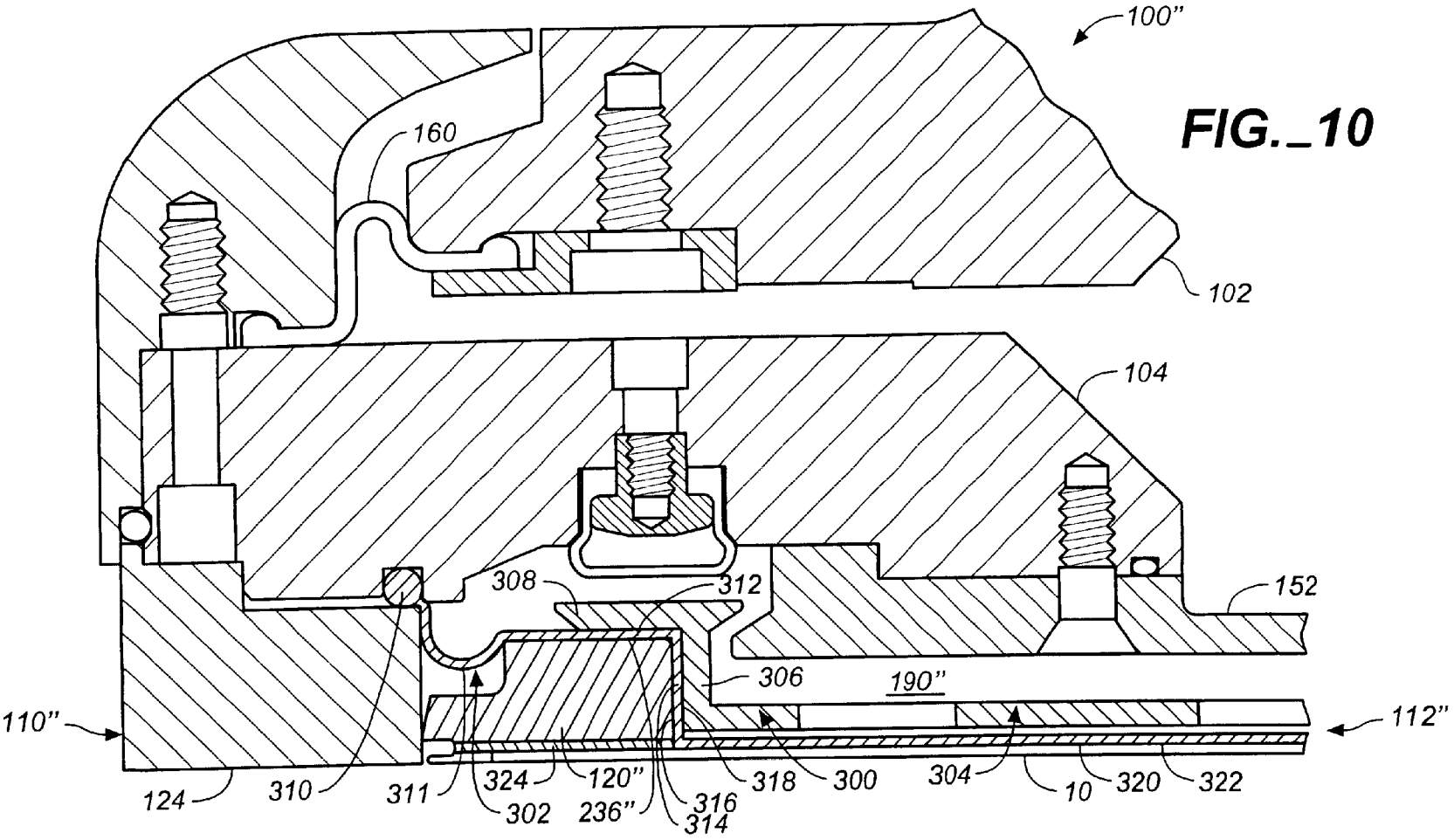
FIG. 10 is a schematic cross-sectional view of a carrier head according to another embodiment of the present invention.

Referring to FIG. 10, a carrier head 100" includes a support structure 300 and a load assembly 121" which includes a backing membrane 302 which combines the functions of flexure diaphragm 116 and flexible membrane 118, and an edge load ring 120". Support structure 300 may be a rigid bowl-shaped member including a disk-shaped bottom plate 304, a cylindrical sidewall 306, and a generally annular rim 308. Rim 308 projects over edge load ring 120" and is positioned beneath bladder 145.

Backing membrane 302 is a generally circular sheet having an outer edge 310 which is clamped between retaining ring 110" and base 104 to secure the backing membrane 302 to the carrier head. A portion 311 of the backing membrane 302 extends inwardly from edge 310 to be clamped between an upper surface 236" of edge load ring 120" and a lower surface 312 of support structure rim 308. Another portion 314 of backing membrane 302 extends between an inner surface 316 of edge load ring 120" and an outer surface 318 of support structure sidewall 306. A central portion 320 of the backing membrane extends below support structure bottom plate 304 to provide a first surface 322 to engage a central portion of the substrate.

Edge load ring 120" is positioned between support structure 300 and retaining ring 110". A lower surface 234" of edge load ring 120" may be covered by a layer of compressible material such as a carrier film. Edge load ring 120" provides a second surface 324 to engage a perimeter portion of the substrate.

In operation, the pressurization of chamber 190" forces backing membrane 302 and edge load ring 120" downwardly to apply a load to the central portion and the perimeter portion of the substrate.

The present invention has been described in terms of a number of embodiments. The invention, however, is not limited to the embodiments depicted and described. Rather, the scope of the invention is defined by the appended claims.

What is claimed is:

1. A carrier head for chemical mechanical polishing, comprising:

a base;

a flexible membrane extending beneath the base to define a pressurizable chamber, a lower surface of the flexible membrane providing a substrate receiving surface of a substrate, the lower surface including a first surface to apply a first pressure to a first portion of the substrate;

a second surface surrounding the first surface to apply a second pressure on a second portion of the substrate;

an edge load ring surrounding the second surface, a lower surface of the edge load ring providing a third surface to apply a third pressure to a third portion of the substrate surrounding the second portion; and a retaining ring surrounding the edge load ring to maintain the substrate beneath the first, second and third surfaces.

2. The carrier head of claim 1, further including an annular wall portion surrounding and connected to the first surface of the flexible membrane, the wall portion having a lower surface and an upper surface, the lower surface defining the second surface.

3. The carrier head of claim 2, further comprising a spacer ring having a lower surface and an upper surface, the upper surface of the spacer ring arranged to receive a load in response to the pressurization of the chamber, the lower surface of the spacer ring abutting the upper surface of the wall portion, whereby the load received on the upper surface of the spacer ring is transferred to the wall portion.

4. The carrier head of claim 3, wherein the spacer ring is positioned between the edge load ring and the wall portion.

5. The carrier head of claim 3, wherein the spacer is positioned on the wall portion and substantially horizontally aligned with a top portion of the edge load ring.

6. The carrier head of claim 3, wherein a surface area of the upper surface of the spacer ring is greater than a surface area of the lower surface of the spacer ring.

7. The carrier head of claim 3, wherein a surface area of the upper surface of the spacer ring is substantially the same as a surface area of the lower surface of the spacer ring.

8. The carrier head of claim 2, wherein the edge load ring includes a top portion extending over the upper surface of the wall member and defining an upper surface of the edge load ring, the upper surface configured to receive a load in response to the pressurization of the chamber and apply the second pressure to the second portion of the substrate and the third pressure to the third portion of the substrate.

9. The carrier head of claim 8, wherein a surface area of the top surface of edge load ring is greater than a surface area of the lower surface of the edge load ring.

10. The carrier head of claim 8, wherein a surface area of the top surface of the edge load ring is less than a surface area of the lower surface of the edge load ring.

11. A method of polishing a substrate, comprising:

bringing the substrate into contact with a polishing surface;

applying a first pressure to a first portion of the substrate with a first portion of a flexible membrane;

applying a second pressure that is different from the first pressure to a second portion of the substrate with a second portion of the flexible membrane; and applying a third pressure that is different from the first pressure and the second pressure to a third portion of the substrate with a rigid edge load ring, wherein applying the third pressure includes transferring a load from a third portion of the flexible membrane to a top surface of the edge load ring.

12. A carrier head for chemical mechanical polishing, comprising:

a base;

a flexible membrane extending beneath the base to define a pressurizable chamber, a lower surface of the flexible membrane providing a first surface to apply a first pressure to a first portion of a substrate and including an annular wall portion providing a third surface to apply a third pressure to a third portion of the substrate;

an edge load ring surrounding the first surface and having an upper surface and a lower surface, the lower surface of the edge load ring providing a second surface for applying a second pressure to a second portion of the substrate, the third portion of the substrate located between the first portion and the second portion; and a retaining ring surrounding the edge load ring to maintain the substrate beneath the first and second surfaces.

13. The carrier head of claim 12, further including a spacer ring positioned above an upper surface of the wall portion and cooperating with the edge load ring to provide the third pressure to the third portion of the substrate.

14. A carrier head for chemical mechanical polishing, comprising:

a base;

a flexible membrane extending beneath the base to define a pressurizable chamber, a lower surface of the flexible membrane providing a substrate receiving surface, the lower surface including a first surface to apply a first pressure to a first portion of the substrate, a second surface to apply a second pressure that is different than the first pressure, to a second portion surrounding the first portion, and a third surface to apply a load;

a rigid edge load ring surrounding the second surface, wherein the third surface of the flexible membrane applies the load to a top surface of the edge load ring, and wherein a contact surface of the edge load ring applies a third pressure to a third portion of the substrate surrounding the second portion; and a retaining ring surrounding the edge load ring to maintain the substrate beneath the first, second and third surfaces.

15. The carrier head of claim 12, wherein a surface area of the upper surface of the edge load ring being at least fifty percent of a surface area of the lower surface of the edge load ring.

16. The carrier head of claim 14, wherein the rigid edge load ring is vertically movable relative to the retaining ring.

* * * * *